US005676060A

United States Patent [19]

Van Lierde

[11] Patent Number: 5,676,060

[45] Date of Patent: Oct. 14, 1997

[54] FLOOR CHAIN TRANSFER SYSTEM

[75] Inventor: Carlos Van Lierde, Kalken, Belgium

[73] Assignee: Elektriciteit Voor Goederenbehandeling Marine En Industrie in het verkort Egemin, naamloze vennootschap, Belgium

[21] Appl. No.: 399,467

[22] Filed: Mar. 7, 1995

[30] Foreign Application Priority Data

Mar. 8, 1994 [BE] Belgium ..... 09400252

[51] Int. Cl.[6] ..... B61B 10/00

[52] U.S. Cl. ..... 104/172.3; 104/130.09; 104/172.2

[58] Field of Search ..... 104/130.09, 172.1, 104/172.2, 172.3, 172.4, 172.5

[56] References Cited

U.S. PATENT DOCUMENTS

| | | | |
|---|---|---|---|
| 3,044,415 | 7/1962 | Dehne | 104/130.09 |
| 3,048,126 | 8/1962 | Salapatas | 104/130.09 |
| 3,407,751 | 10/1968 | Orwin | 104/172.2 |
| 3,648,618 | 3/1972 | Pierson et al. . | |
| 3,714,903 | 2/1973 | Rosenberger, Jr. et al. . | |
| 3,771,464 | 11/1973 | Reiche | 104/172.2 |
| 4,242,965 | 1/1981 | Granet | 104/172.1 |
| 5,537,930 | 7/1996 | Van Lierde | 104/172.3 |

FOREIGN PATENT DOCUMENTS

| | | | |
|---|---|---|---|
| 2 659 946 | 3/1990 | France . | |
| 92 04 632 | 4/1992 | Germany . | |
| 919946 | 4/1982 | U.S.S.R. | 104/172.2 |
| 964 022 | 7/1962 | United Kingdom . | |
| 1 166 694 | 8/1967 | United Kingdom . | |

*Primary Examiner*—Mark T. Le
*Attorney, Agent, or Firm*—Bacon & Thomas

[57] ABSTRACT

The transmission system (5) contains two horizontal sprocket wheels (12 and 15) turning in the opposite sense over which run two floor chains (9 and 13) which carry protruding catch elements (10 and 14) for engaging driving pins (17) of conveyor transport units, and which are situated such that a pin (17) which is carried by a catch element (10) from the one floor chain system (2) is released from the catch element (10) at the sprocket wheels (12 and 15) and is carried along by a catch element (14) from the other floor chain system (4), wherein the theoretical outline (25) which describes the outermost travel path of all the catch elements (10) of the one floor chain system (2) and the theoretical outline (26) which describes the outermost travel path of all the catch elements (14) of the other floor chain system (4), at the intersection with the theoretical joining line (20) between the shafts (18 and 19) of the two sprocket wheels (12 and 15), are situated at a distance from one another between zero and the thickness of the pins (17) along the above-mentioned joining line (20), and wherein the transmission system (5) contains a kinematic connection (21–22) with a constant drive or speed ratio between the two sprocket wheels (12 and 15).

12 Claims, 3 Drawing Sheets

Fig.1
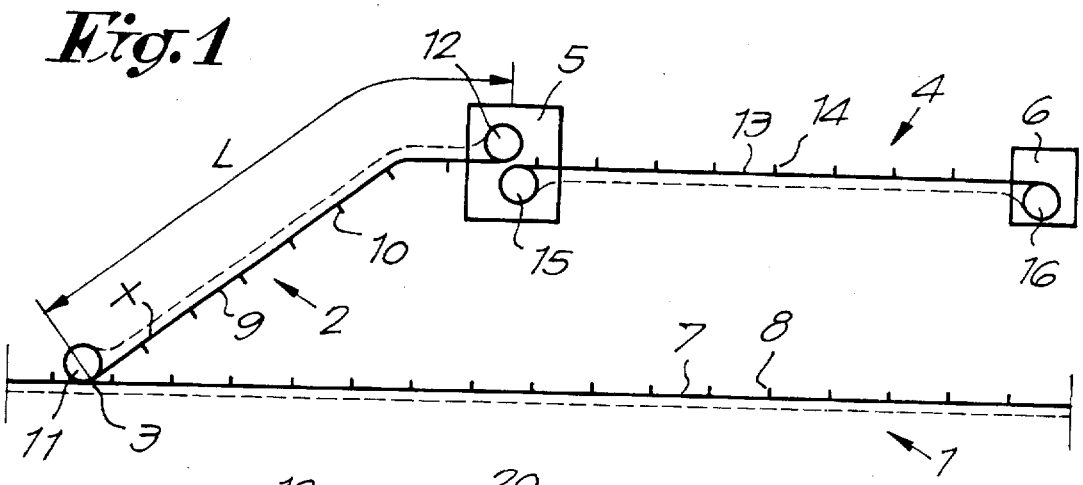
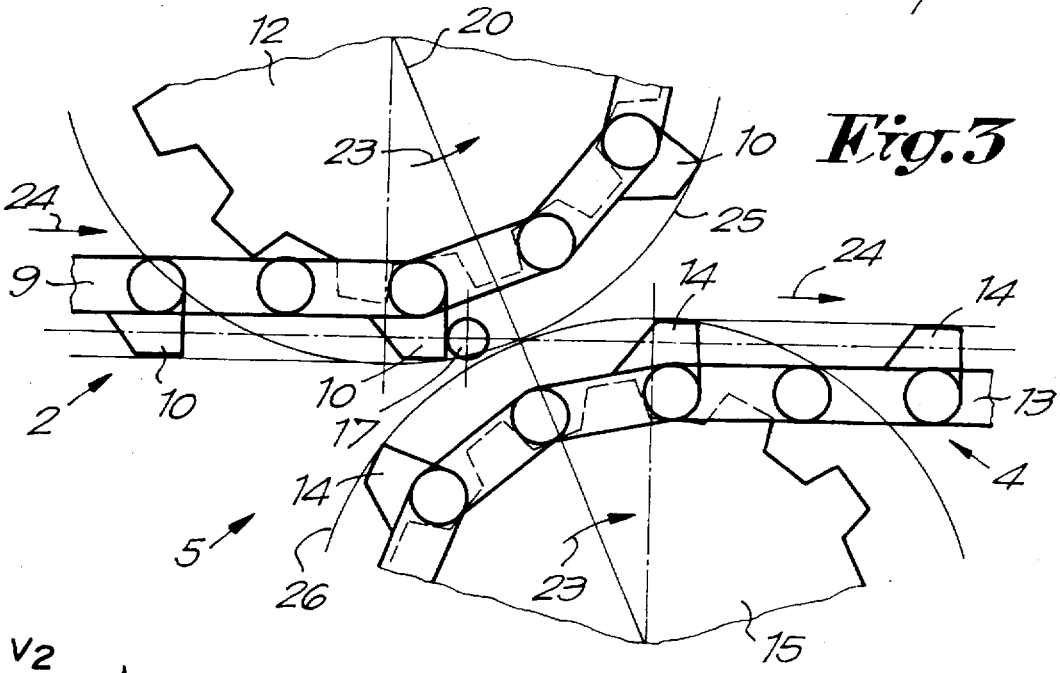
Fig.3
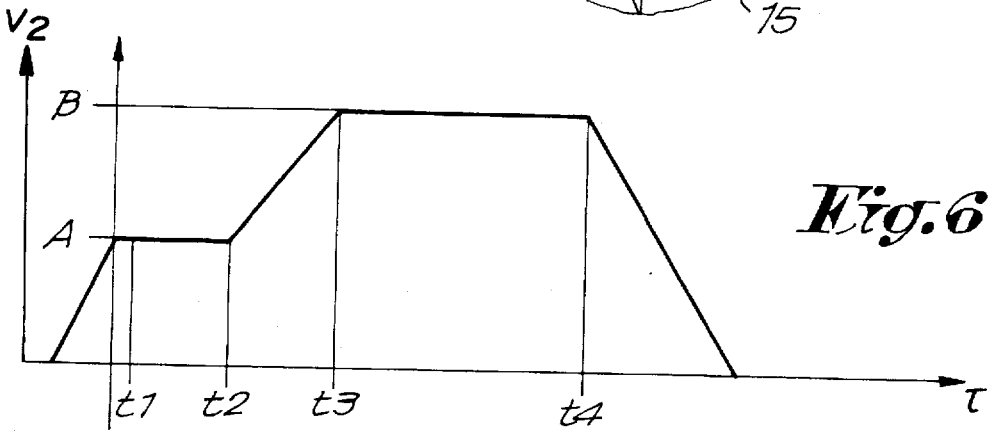
Fig.6

FLOOR CHAIN TRANSFER SYSTEM

BACKGROUND OF THE INVENTION

1. Field of the Invention

The invention concerns a transmission system to transfer conveyor transport units from one floor chain drive system to another, which transmission system contains two horizontal sprocket wheels turning in the opposite sense over which run two floor chains which carry protruding catch elements for moving driving pins carried by the conveyor transport units, and which are situated such that a driving pin which is carried by a catch element from the one floor chain system is released from said catch element at the sprocket wheels and is then carried along by a catch element from the other floor chain system.

2. Discussion of the Prior Art

In known transmission systems of this type the paths of the catch elements of the two floor chain systems overlap at the location of the above-mentioned sprocket wheels, where the actual transmission takes place, over a certain distance. This means that a theoretical line which defines the outermost path of travel of all the catch elements of the one floor chain system and the corresponding theoretical line which defines all the outermost paths of travel of the catch elements of the other floor chain system intersect or cross one another at the overlap position.

This has for a result that the ratio between the speed of the catch elements of the one floor chain system and the speed of the catch elements of the other floor chain system must be equal to 1 (unity) or can at the most be equal to ½ or ⅔. With other ratios the risk of a pin getting stuck sooner or later between a catch element of the one floor chain system and a catch element of the other floor chain system at the overlap (causing transmission system jamming), is very great. For different speed ratios the floor chain systems must be driven separately, which makes the entire system expensive, and the drive devices require much space, especially as far as the floor built-in depth is concerned.

SUMMARY OF THE INVENTION

The invention aims to remedy this disadvantage and to provide a transmission system to transfer conveyor transport units from one floor chain system to another one which is relatively inexpensive, requires relatively little space and allows for almost any transmission speed ratio whatsoever between both floor chain systems without any jam risks.

This aim is reached according to the invention because the theoretical outline which describes all the outermost paths of travel of the catch elements of the one floor chain system and the theoretical outline which describes all the outermost paths of travel of the catch elements of the other floor chain system, where they intersect the theoretical joining line between the shafts of the two sprocket wheels, are situated at a distance from one another that is between zero and the thickness of the pins along the direction of the above-mentioned joining line, and the transmission system contains a kinematic connection providing a constant speed ratio between the two sprocket wheels.

The above-mentioned outlines do not actually intersect or cross but only just touch or barely touch one another. This avoids jamming, not only when using different speeds for the two floor chain systems but also when the pitch between the catch elements of the one system differs from the pitch between the catch elements of the other floor chain system. Also, because of the gear wheels, it is only necessary to drive one of the floor chain systems.

Practically, the kinematic connection contains two engaged gear wheels which are respectively connected coaxially to the two sprocket wheels.

If the pins are round, in practice the above-mentioned distance between the outermost motion paths is smaller than ¾ of the diameter of the pins and preferably smaller than ½ of this diameter. According to the most preferred embodiment, said distance is zero and the above-mentioned outlines touch one another.

The two gear wheels may have a transmission drive ratio of 1/1 as well as other ratio M/N, for example 2/1, 3/1, 3/2, 4/1, 4/3, 5/2, 5/3, 5/4; wherein M and N are whole, positive numbers.

For different transmission drive ratios one only has to provide other gear wheels in one and the same transmission system. This allows for standardization.

For a good operation, one has to make sure that at least one catch element of the one floor chain system cooperates with at least one catch element of the other floor chain system, and such that if the one catch element intersects the imaginary joining line between the two shafts of the sprocket wheels or lies on the point of contact of the two described outermost motion paths of the catch elements, the other cooperating catch element lags at a distance or follows somewhat later. This distance may not exceed a value Q which is preferably smaller than twice the diameter of a driving pin and preferably smaller than ¾ of the diameter of the pin.

With a transmission drive between the gear wheels of M/N=VM/VN, whereby VM is the rotational speed of the fastest sprocket wheel and VN is the rotational speed of the slowest sprocket wheel, and with a pitch P between the catch elements on both floor chain systems, the diameter of the pin must be related to Q as described above and with a small clearance, preferably smaller than P/M (wherein M and N are smallest common divisors).

According to a specific embodiment of the invention, P1/P2=VN/VM=N/M is possible, whereby P1 is the pitch of the one, faster, floor chain system with a speed VM, and P2 is the pitch of the other, slower, floor chain system with a speed VN.

In a following specific embodiment of the invention this constant ratio may be altered with YM/XN, where Y and X are whole numbers, YM is the rotational speed of the fastest sprocket wheel, and XN is the rotational speed of the slowest sprocket wheel. In this manner, the diameter of a pin must be increased with increasing Q and only increased with a small clearance, preferably smaller than P2/Y.

According to a specific embodiment of the invention, the transmission system contains a spring pawl which, as seen in the direction of movement of the pins, is mainly situated before the point where the outermost travel paths are situated closest together and which is brought or biased into the path of the driving pins by means of a spring element, so that a pin which moves towards said point must push away this pawl in a resilient manner and cannot move backwards due to the pawl.

The pawl slows the pins down somewhat and ensures that the pins are connected to the catch element, but most of all it prevents the conveyor transport unit from being moved in a direction opposite its normal direction of movement at a moment during the transmission at which the catch element of the one floor chain system has already released the pin, but no catch element of the other floor chain system is situated behind the pin yet.

The invention also concerns a method for hauling a conveyor transport unit from a main chain path to a side chain path whereby a transmission system according to any of the preceding embodiments is practically used.

Thus, the invention concerns a method for hauling a conveyor unit from a main chain path which forms a floor chain system to a side chain path which forms another floor chain system, and where a branch is present which forms yet another floor chain system which is connected onto the main chain path via a switch on the one hand and onto the side chain path via a transmission system on the other hand and whereby the branch as well as the main chain path and the side chain path consist of endless floor chains which can be driven separately and which carry catch elements which work in conjunction with driving of the conveyor transport units in order to carry along the latter and whereby during the haulage the floor chain of the branch is driven at a higher average speed than the floor chain of the side chain path.

The side chain path is mostly used for shunting conveyor transport units which are disconnected later from the side chain path and possibly connected again to the main chain path. The side chain path is usually driven discontinuously. Each time a new conveyor transport unit is hauled via the branch, the shunted conveyor transport units move up one place.

The aim of the different speeds between the floor chains is to let the haulage take place as fast as possible and, in case conveyor transport units are shunted on the side chain path, to make it possible to shunt these conveyor transport units as close as possible to one another without colliding.

However, the speed of the floor chain of the branch may not be much higher than the speed of the floor chain of the main chain path, since the acceleration at the time of the transfer of the conveyor transport unit from the branch to the floor chain would be too great.

The invention aims to remedy this disadvantage and to provide a method by which the haulage can be done relatively fast but yet smoothly.

This aim is reached according to the invention because, at the beginning of the haulage of a conveyor transport unit, the floor chain of the branch is driven at a speed which is more or less equal to that of the floor chain of the main chain path, and only afterwards is the floor chain of the branch speeded up to a maximum speed which is higher and which is maintained almost until the conveyor transport unit is located at the transmission system, after which the floor chain of the branch is slowed down again.

According to a particular embodiment, the floor chain of the branch is driven discontinuously and this floor chain is speeded up from standstill to a speed which is practically equal to the speed of the floor chain of the main chain path before the conveyor transport unit is hauled to the floor chain of the branch.

In practice, a transmission system according to any of the preceding embodiments is used as a transmission system.

In this embodiment, the floor chain of the side chain path is also driven discontinuously.

Preferably, the average speed of the floor chain of the side chain path when being driven is hereby slower than the speed of the floor chain of the main chain path.

When the side chain path is a shunting track with stops for the conveyor transport units, the average speed of the floor chain of the branch and the average speed of the floor chain of the side chain path are selected such that a conveyor transport unit covers the distance between the switch and the transmission system in almost the same time that a conveyor transport unit is being moved from one stop to the next.

BRIEF DESCRIPTION OF THE DRAWINGS

FIG. 1 is a schematic representation of two floor chain systems with a transmission system according to the invention;

FIG. 3 represents the detain indicated by F3 in FIG. 2, to yet a larger scale;

FIG. 6 represents a diagram with the speed of a part of the floor chain system as a function of time.

DETAILED DESCRIPTION OF THE PREFERRED EMBODIMENT

Figure 2:
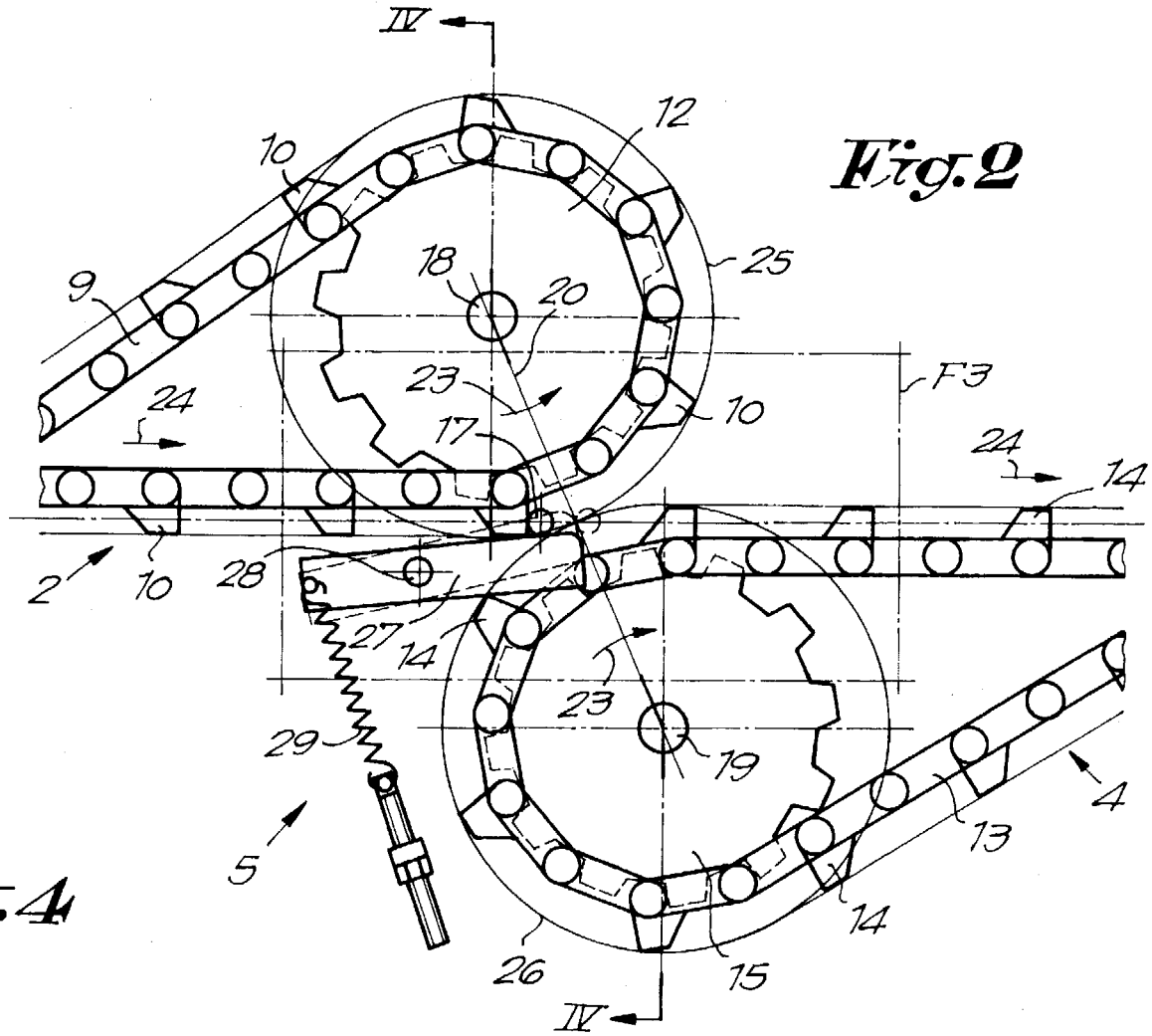
FIG. 2 is a schematic representation to a larger scale of the transmission system from the floor chain system in FIG. 1.
Figure 4:
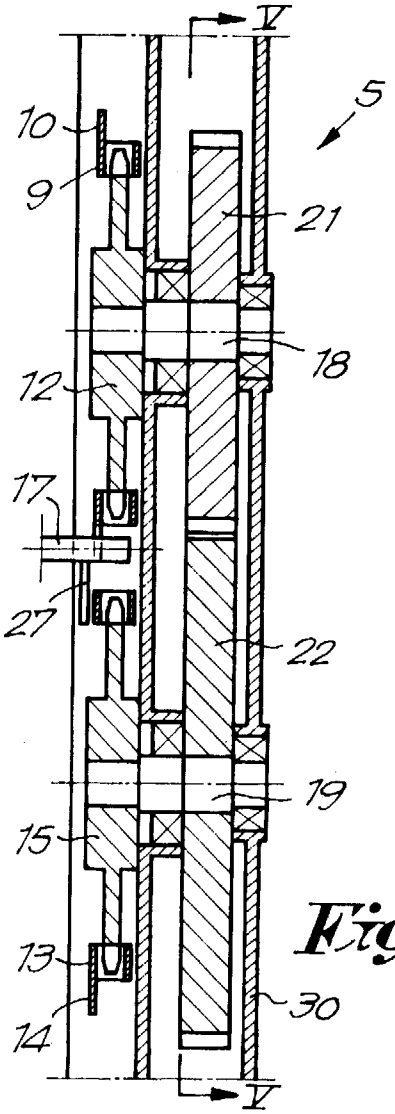
FIG. 4 represents a section according to line IV—IV in FIG. 2.

The transport system represented in FIG. 1 includes a main chain path 1 which forms a first floor chain system, a branch chain path 2 running away from the main path 1 in a slanting or diagonal manner which forms a second floor chain system and which is connected to the main chain path 1 at a switch 3 and a side chain path 4 which forms a third floor chain system and which is connected to the branch 2 by means of a transmission system 5 on the one hand, and which is connected to a drive 6 on the other hand.

The main chain path 1 contains an endless floor chain 7 which carries a number of catch elements 8 and which is continuously driven by a drive which is not shown.

The branch 2 also consists of an endless floor chain 9 which carries catch elements 10 and which runs over two sprocket wheels 11 and 12 of which one is situated close to the switch 3 and the other is part of the transmission system 5.

The side chain path 4 forms a shunting track and also consists of an endless floor chain 13 which carries catch elements 14 and which runs over two sprocket wheels 15 and 16. The sprocket wheel 15 is part of the transmission system 5, whereas the sprocket wheel 16 is discontinuously driven by the drive 6.

The floor chains 7, 9 and 13 are built into a floor (not shown) and the catch elements 10 and 14 protrude horizontally sideways. The catch elements 8 of the floor chain 7 can be placed on top of the floor chain 7 (block chain) or laterally on the floor chain 7 (drag chain). These catch elements work in conjunction with usually vertically extending round driving pins 17 of conveyor transport units which, for clarity's sake, are not represented in FIG. 1. These conveyor transport units may be trolleys, pallet carriers, etc. which are equipped with wheels with which they roll over the floor when their driving pin 17 is carried along by a catch element 8, 10 or 14.

The construction of the switch 3 is known as such and is not described in detail. In one position it lets the pins 17 through, whereas in another position it diverts the pins to the branch 2 so that they can be carried along by a catch element 10.

Figure 5:
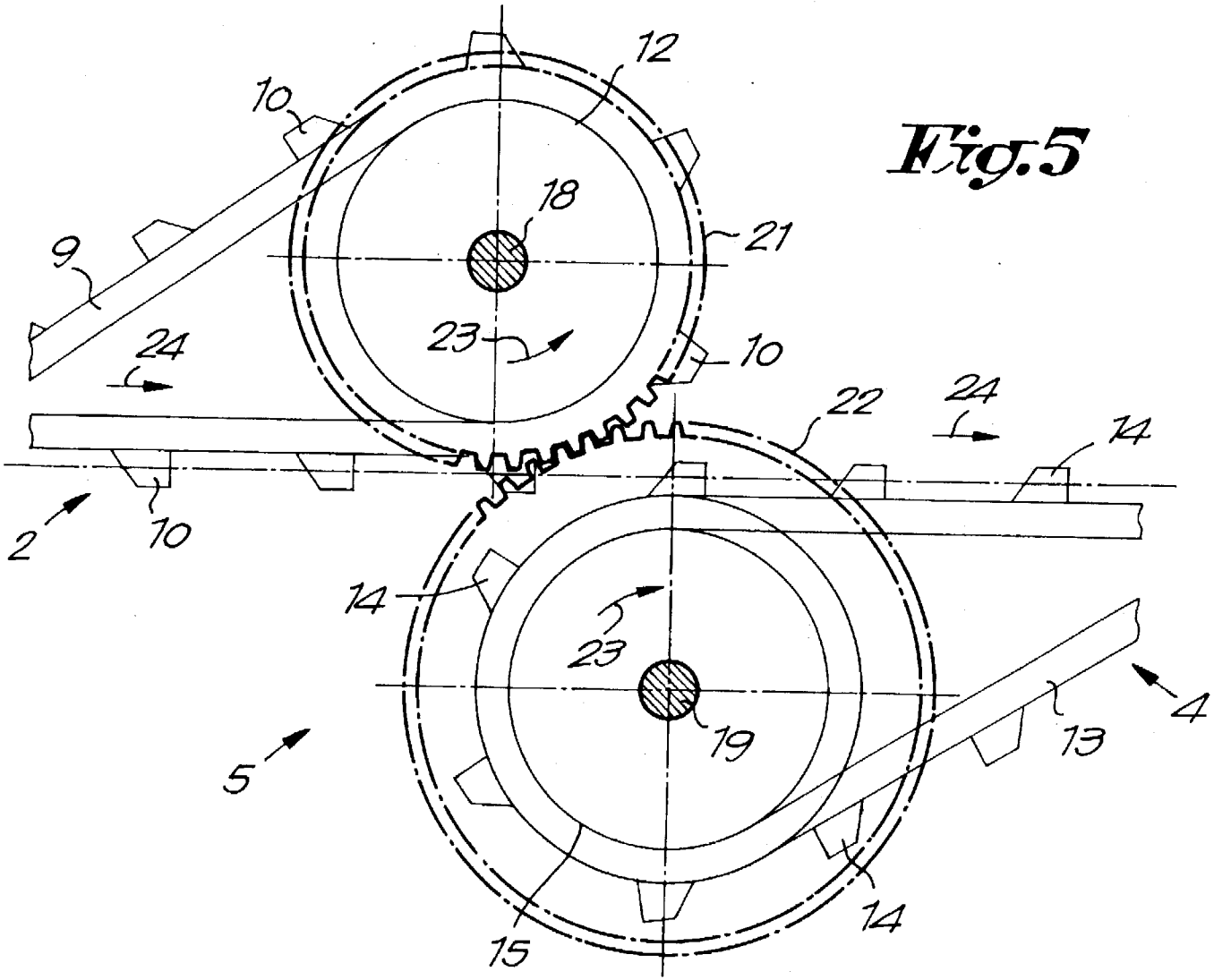
FIG. 5 represents a section according to line V—V in FIG. 4.

As is represented in particular in the FIG. 2 and 5, the two sprocket wheels 12 and 15 are mounted in a rotating manner around vertical shafts 18 and 19 in a housing 30. The theoretical or imaginary joining line 20 extending between these shafts 18 and 19 forms an angle with the longitudinal direction of the active parts of the floor chain 9 and 13 at the transmission system 5.

These active chain parts move in the same direction because the sprocket wheels 12 and 15 rotate in the opposite sense with engaged gear wheels 21 and 22 mounted on parallel shafts 18 and 19. The sense of rotation of the chain wheels 12 and 15 is indicated in FIGS. 2 and 3 by arrows 23 whereas the direction of movement of the used or active parts of the floor chains 9 and 13 are indicated by arrows 24.

Characteristic of the invention is the fact that the theoretical outline 25 which defines the outermost path of travel of the catch elements 10 of the branch 2 and the theoretical outline 26 which defines the outermost path of travel of the catch elements 14 of the side chain path 4 do not intersect or cross but rather just touch one another right at said imaginary joining line 20. Instead of touching one another, these lines could be situated at a small distance from one another, which distance should be definitely smaller, however, than the diameter of the pins 17 and in practice even smaller than ¾ and preferably even ½ of this diameter.

The transmission system 5 works as follows:

The floor chain 13 is driven by the drive 6. The sprocket wheel 12 is driven by gear wheels 22 and 21 at a higher speed at a drive ratio of m/n, where m is the rotational speed of the gear wheel 21, and n is the rotational speed of the driving gear wheel 22. The ratio of the speeds of the floor chains 9 and 13 is the same (m/n).

When a pin 17 and thus a conveyor transport unit is carried along by a catch element 10 of the branch 2, this pin 17 is released entirely from the catch element 120 just beyond the theoretical joining line 20, after which it (the pin 17) is taken further along in the same direction by one catch element 14 of the side chain path 4. For clarity's sake, only one pin 17 is represented in FIGS. 2 and 3, where said pin 17 is represented as a dashed line where it is essentially released from the catch element 10.

In order to make it possible for this pin 17 to be carried along by a catch element 14, the diameter of the pin 17 must be related to a value Q (defined below) and it must be smaller, with a small safety margin, than P/M, where P is the pitch, i.e. the distance between the catch elements 10 or 14 which is constant in the example represented and where Q is the trailing distance of the catch element 14 in relation to the catch element 10 at the moment when the catch element 14 is situated at the joining line 20.

For a good operation, one must make sure that at least one catch element 10 of the one floor chain system 2 corresponds to or cooperates with at least one catch element 14 of the other floor chain system 4, and such that if this one catch element 10 stands on or intersects the joining line 20 between the two shafts 18 and 19 of the sprocket wheels 12 and 15 or on the point of contact of the two described outermost travel paths 25 and 26 of the catch elements 10 and 14, the other (cooperating) catch element 14 lags at a distance or follows somewhat later.

This distance may not exceed a value Q which is preferably smaller than twice the diameter of a pin 17 and preferably smaller than ¾ of the diameter of the pin 17.

The transmission drive ratio m/n may have different values such as 1/1, 2/1, 3/2, 4/1, 4/3, 5/2, 5/3, 5/4, etc. without any risk of the pin 17 jamming the transmission system 5.

The pitch P of the branch 2 may possibly differ from the pitch P of the side chain path 4.

Since, at the moment when a pin 17 is released by a catch element 10, a catch element 14 is not necessarily situated behind said pin 17 yet, the conveyor transport unit could slide or slip backward with said pin 17. In order to avoid this, the transmission system includes a pawl 27 which is hinge-mounted around a shaft 28 and is mainly situated in front of the joining line 2 (i.e., towards branch 2). Said pawl 27 is pulled or biased in the position which is represented in FIG. 2 by a dashed line by a spring 29 and whereat the end of said pawl 27 is situated on the path of the pins 17. This pawl 27 is deflected against the bias by a pin 17 which is carried along in the direction of the arrow 24. This pin is hereby slowed down somewhat. A movement of the pin in the opposite direction is thereby prevented by the pawl 27.

The above-described transmission system 5 makes it possible to make the speed of the branch 2 differ from the speed of the side chain path 4 when both are in motion. By replacing the gear wheels 21 and 22, this difference can be easily altered with one and the same transmission system.

Moreover, one can vary the speed of the branch 2 over time, which offers particular advantages, whereby the speed of the side chain path 4 varies proportionally.

FIG. 6 represents a diagram showing variation of the speed ($V_2$) of the branch 2 as a function of time (t).

As can be derived from this diagram, the speed $V_2$ (represented on the vertical scale) of the floor chain 9 of the branch 2 is varied over time (represented on the horizontal scale) according to the invention.

One first speeds up from zero to an intermediate value A which is practically equal to the speed of the main chain path 1, and such before the pin 17 of a conveyor unit reaches the switch.

At the time of the transfer t1 of this pin to the floor chain 9, the latter moves already at practically the same speed as the floor chain 7, as a result of which the transfer can take place very softly and smoothly.

This speed is maintained for a while and at the time t2, at which the pin has reached the position X represented in FIG. 1, the floor chain 9 is speeded up to a speed B which is significantly higher. This speed, reached at t3, is maintained for a while until t4, at which time the pin 17 reaches the transmission system 5 of reaches it almost or has already reached out.

Afterwards, the floor chain 9 is slowed down to a standstill.

The maximum speed B is selected such that the pin 17 has covered a desired distance L before a new pin 17 has arrived at the switch 11. This implies that the pin 17 must be able to cover the distance between two stops in the chain system within this time.

The transfer can take place at maximum speed, during a speed reduction or during an acceleration.

The average speed of the endless chain 13 of the side chain path 4 can be selected freely in this manner. Preferably, this speed is selected to be slower than the speed of the main chain path 1.

It is clear that the speed of the floor chain 13 of the side chain path 4, due to the fixed transmission ratio of the gear wheels 21 and 22 of the transmission system 5, will vary together with the speed of the floor chain 9.

The haulage can in this way take place very fast but smoothly and without sudden shocks.

The present invention is by no means limited to the above-described embodiments represented in the accompanying drawings; on the contrary, such a transmission system or method for hauling can be made in all sorts of variants while still remaining within the scope of the invention.

I claim:

1. A transmission system for transferring conveyor transport units carrying driving pins, each having a predetermined diameter or thickness, from one floor chain system to another comprising:

first and second sprocket wheels having associated first and second sprocket wheel shafts defining respective first and second rotational axes for said first and second sprocket wheels;

means for rotating said first and second sprocket wheels in opposite rotational directions, said rotating means including a kinematic connection unit having a constant associated drive ratio between said first and second sprocket wheels;

first and second floor chains drivingly connected to said first and second sprocket wheels respectively, each of said first and second floor chains having protruding therefrom a plurality of spaced catch elements for engaging the driving pins carried by the conveyor transport units with a pin engaged by one of said catch elements on said first floor chain becoming disengaged therefrom at a predetermined location relative to said first and second sprocket wheels, wherein a first theoretical outline which defines an outermost path of travel of the catch elements of said first floor chain is spaced, along an imaginary line connecting the first and second rotational axes, from a second theoretical outline which defines an outermost path of travel of the catch elements of said second floor chain by a distance ranging between zero and the predetermined diameter or thickness of said pins.

2. The transmission system according to claim 1, wherein said kinematic connection unit comprises two engaged gear wheels which are attached to said first and second sprocket wheel shafts, and in coaxial relationship with said first and second sprocket wheels, respectively.

3. The transmission system according to claim 1, wherein each of the driving pins is circular and has an associated diameter, said distance being smaller than ¾ of said diameter.

4. The transmission system according to claim 3, wherein said distance is smaller than ½ of said diameter.

5. The transmission system according to claim 1, wherein said first and second theoretical outlines intersect along the imaginary line connecting the first and second rotational axes.

6. The transmission system according to claim 1, wherein each of the driving pins has an associated diameter, one of said catch elements of said second floor chain is spaced from one of said catch elements of said first floor chain that is located on said line by a gap smaller than twice said associated diameter.

7. The transmission system according to claim 6, wherein the gap is smaller than ¾ said associated diameter.

8. The transmission system according to claim 1, wherein said kinematic connection unit has an associated transmission drive ratio which is a value other than unity.

9. The transmission system according to claim 1, further comprising a pawl member located in advance of said imaginary line and an elastic element biasing said pawl member into a path traversed by the driving pins during operation of said transmission system such that each said pin must deflect said pawl member, against a biasing force of said elastic element to cross said line and is restrained against backwards motion due to the presence of said pawl.

10. The transmission system according to claim 8, wherein said transmission drive ratio is defined by M/N=VM/VN where M and N are whole numbers, M/N is the transmission drive ratio of the first and second sprocket wheels, VM is the rotational speed of a faster one of said first and second sprocket wheels, and VN is the rotational speed of a slower one of said first and second sprocket wheels; and wherein the diameter or thickness of each of said driving pins, plus said distance and a predetermined clearance, is smaller than P/M where P equals a pitch between the catch elements on each of said first and second floor chains.

11. The transmission system according to claim 8, wherein said transmission drive ratio is defined by N/M=VN/VM=P1/P2 where M and N are whole numbers, N/M is the transmission drive ratio of the first and second sprocket wheels, VM is the rotational speed of a faster one of said first and second sprocket wheels, VN is the rotational speed of a slower one of said first and second sprocket wheels, P1 is the pitch of the faster one of said first and second floor chains, and P2 is the pitch of the slower one of said first and second floor chains.

12. The transmission system according to claim 8, wherein P1/P2=YM/XN where M, N, X and Y are whole numbers, P1 is the pitch of a faster one of said first and second floor chains, P2 is the pitch of a slower one of said first and second floor chains, M and N are the numerical elements of transmission drive ratio M/N of the first and second sprocket wheels, YM is the rotational speed of the faster one of said first and second sprocket wheels, and XN is the rotational speed of the slower one of said first and second sprocket wheels, whereby the diameter or thickness of each of said driving pins, plus said distance and a small clearance, is smaller than P2/Y.

* * * * *